US007267515B2

(12) United States Patent
Lappöhn

(10) Patent No.: US 7,267,515 B2
(45) Date of Patent: Sep. 11, 2007

(54) PLUG-AND-SOCKET CONNECTOR

(75) Inventor: Jürgen Lappöhn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/347,065

(22) Filed: Feb. 3, 2006

(65) Prior Publication Data

US 2007/0155241 A1 Jul. 5, 2007

(30) Foreign Application Priority Data

Dec. 31, 2005 (DE) ..... 20 2005 020 474 U

(51) Int. Cl.
*H01R 13/648* (2006.01)

(52) U.S. Cl. ..... 409/608

(58) Field of Classification Search ..... 439/608, 439/607, 108

See application file for complete search history.

(56) References Cited

U.S. PATENT DOCUMENTS

| | | | | |
|---|---|---|---|---|
| 5,066,236 | A | 11/1991 | Broeksteeg | |
| 5,702,258 | A * | 12/1997 | Provencher et al. | 439/79 |
| 6,146,202 | A * | 11/2000 | Ramey et al. | 439/608 |
| 6,299,484 | B2 * | 10/2001 | Van Woensel | 439/608 |
| 6,343,955 | B2 * | 2/2002 | Billman et al. | 439/608 |
| 6,347,962 | B1 * | 2/2002 | Kline | 439/608 |
| 6,371,813 | B2 * | 4/2002 | Ramey et al. | 439/608 |
| 6,409,543 | B1 * | 6/2002 | Astbury et al. | 439/608 |
| 6,461,202 | B2 * | 10/2002 | Kline | 439/701 |
| 6,506,076 | B2 | 1/2003 | Cohen et al. | |
| 6,808,420 | B2 * | 10/2004 | Whiteman et al. | 439/608 |
| 6,872,085 | B1 * | 3/2005 | Cohen et al. | 439/108 |
| 6,899,566 | B2 * | 5/2005 | Kline et al. | 439/608 |
| 6,913,490 | B2 * | 7/2005 | Whiteman et al. | 439/608 |
| 6,979,226 | B2 * | 12/2005 | Otsu et al. | 439/608 |
| 7,094,102 | B2 * | 8/2006 | Cohen et al. | 439/608 |
| 7,097,506 | B2 * | 8/2006 | Nakada | 439/608 |
| 7,108,556 | B2 * | 9/2006 | Cohen et al. | 439/608 |
| 2001/0046810 | A1 * | 11/2001 | Cohen et al. | 439/608 |
| 2002/0111069 | A1 * | 8/2002 | Astbury et al. | 439/608 |

FOREIGN PATENT DOCUMENTS

EP 0 422 785 A2 9/1990

* cited by examiner

*Primary Examiner*—Tulsidas C. Patel
*Assistant Examiner*—Phuongchi Nguyen
(74) *Attorney, Agent, or Firm*—Collard & Roe, P.C.

(57) ABSTRACT

A multi-pole, multi-row plug-and-socket connector with shielding, for placement on printed circuit boards, circuit cards, and similar electrical components, which can be used in an electrical or electronic system includes electrical contact parts for the transmission of signals, which possess a connection section on one end and an electrically conductive attachment section on the other end, as well as an electrical shielding, which possesses at least one electrically conductive contact section. The free ends of the electrically conductive attachment sections of the electrical contact parts are SMD contacts. The at least one electrically conductive contact section of the shielding is, at the same time, an attachment pin which projects into a passage hole of the printed circuit board when the plug-and-socket connector is disposed on the same, for the purpose of connective soldering using THR technology.

13 Claims, 13 Drawing Sheets

PLUG-AND-SOCKET CONNECTOR

CROSS REFERENCE TO RELATED APPLICATIONS

Applicant claims priority under 35 U.S.C. §119 of German Application No. 20 2005 020 474.9 filed on Dec. 31, 2005.

BACKGROUND OF THE INVENTION

1. Field of the Invention

The present invention relates to a multi-pole, multi-row plug-and-socket connector with shielding, with which electrical lines can be connected with one another, preferably in releasable manner. More particularly, the electrical lines are those of electronic components or modules, particularly printed circuit boards, plug-in cards, and similar system components These plug-and-socket connectors can be so-called male multi-point connectors or female multi-point connectors of a plug-and-socket connection.

2. The Prior Art

Users are making ever greater demands on such plug-and-socket connectors with regard to the electrical and mechanical parameters, particularly with regard to high transmission rates as well as great mechanical strength, particularly with regard to good rigidity and pull relief. At the same time, there is the ongoing demand for miniaturization of the contact distances and the size of the plug-and-socket connections. Simultaneously, the production costs are supposed to be lowered, or at least kept (relatively) low.

Plug-and-socket connectors with shielding, for a single-pole or also multi-pole plug-and-socket connection, are known, with such a structure that the plug or socket part, in other words the male multi-point connector or female multi-point connector are provided with large-area shielding plates disposed on the outside or inside of their housing parts. This type of construction, e.g. a plug-and-socket connector according to EP 0 422 785 A2, is effective, with regard to shielding, in the case of interference signals that act on the plug part from the outside. A disadvantage of this plug-and-socket connector is that the mechanical attachment of the printed circuit board takes place by means of a screw connection, whereby the outer shielding elements are fixed in place at the same time.

This type of shielding is not effective for shielding individual electrically conductive contact elements or groups of contact elements, which are particularly multi-pole and furthermore disposed in multiple rows in plug-and-socket connectors provided for the applications mentioned initially. This type of shielding is particularly ineffective if high data rates or high-frequency signals are being transmitted.

SUMMARY OF THE INVENTION

Therefore, it is an object of the present invention to provide a multi-pole, multi-row plug-and-socket connector with shielding, for placement on printed circuit boards, circuit cards, and similar electrical components, which can be used in an electrical or electronic system, particularly a multi-part, multi-pole male multi-point connector or female multi-point connector, in such a manner that even with optimization of the production costs—in other words smaller or lighter plug-and-socket connectors, i.e. less use of materials—very good mechanical strength and very good electrical parameters, i.e. a high transmission rate and very good shielding against spark-over between the signal contacts, etc., can be implemented.

These and other objects are accomplished by providing a multi-pole, multi-row plug-and-socket connector with shielding, for placement on printed circuit boards, circuit cards, and similar electrical components, which can be used in an electrical or electronic system in accordance with the invention. The connector includes at least a housing, on and in which the components of the plug-and-socket connector are positioned and fixed, electrical contact parts for the transmission of signals, which possess a connection section on one end and an electrically conductive attachment section on the other end, as well as an electrical shielding, which possesses at least one electrically conductive contact section. The attachment sections of the electrical contact parts that project out the housing on the assembly side and the contact section of the electrical shielding are disposed according to a predetermined raster and can be connected with the printed circuit board by means of soldering. The free ends of the electrically conductive attachment sections of the electrical contact parts are surface mount device (SMD) contacts and the at least one electrically conductive contact section of the shielding is, at the same time, an attachment pin, which projects into a passage hole of the printed circuit board when the plug-and-socket connector is disposed on the printed circuit board for the purpose of connective soldering using THR technology.

The multi-pole, multi-row plug-and-socket connector may be a female multi-point connector constructed in modular manner having at least two female multi-point connector slices. The multi-pole, multi-row plug-and-socket connector may also be a male multi-point connector.

The electrical shielding of the female multi-point connector slice may be a shield plate having at least two attachment pins that project away in the same body plane, are disposed at the end on both sides with reference to a body edge that lies on the assembly side, and possess a projection that projects away laterally.

More than two attachment pins may be provided on the body edge of the shield plate, whereby the attachment pins that are disposed on the inside, between the two outer ones, do not have a projection. At least one of the attachment pins disposed at the end may have a projection on both sides. One of the two lateral projections may be a shortened projection.

The attachment pins provided on the attachment side body edge may be angled twice by 90°, so that the section of each attachment pin that engages into the printed circuit board is disposed in a plane that lies lateral to the body plane of the shield plate.

An electrically shielding plate may be disposed on the shield plate of each female multi-point connector slice on the inside facing the base body of the female multi-point connector slice, which covers at least a partial region of the inner surface of the shield plate. The shield plate may have at least two angled crosspieces that each engage into a recess of the base body of the female multi-point connector slice, and preferably pass through the same.

A cover that is provided on the base body of a female multi-point connector slice opposite the shield plate and covers accommodation channels of the female multi-point connector slice may be an electrically conductive shielding plate that preferably contacts the crosspieces that pass through the base body. At least two of the angled crosspieces of the shield plate may be formed as barbs, while retaining their shielding function.

The electrical shielding of the male multi-point connector may be formed by shield profile parts, which surround a pair of the provided pin contacts on three sides, in each instance, whereby the shield profile parts pass through the bottom of the base body of the male multi-point connector and surround the attachment sections of the pin contacts that are disposed outside of an outer bottom surface, shielding them. Each shield profile part may have at least one stop that projects out of the body surface, on its assembly side contact section.

An attachment pin may project away from the contact section, which pin, after the male multi-point connector has been set onto the assembly surface of a printed circuit board, projects into a passage hole of the same for the purpose of soldering using through-hole reflow (THR) technology. A surface mount device (SMD) foot may be disposed on the lower edge of the contact section of the shield profile part.

By means of this new multi-pole, multi-row plug-and-socket connector with shielding (referred to hereinafter simply as plug-and-socket connector), the prerequisites are furthermore created for high-quality integration of through-hole reflow (THR) technology into the automated surface mount device (SMD) production process in the production of plug-and-socket connectors of this type of construction, with simultaneously low production costs. By means of this new type of plug-and-socket connector, the THR technology (through-hole reflow) can be used with the SMT (surface mount technology) technology, even with plug-and-socket connectors of the type stated (male multi-point connector and female multi-point connector). In other words this new connector permits the combined use of the high frequency (HF) technical advantages of SMD connections, which support data rates around 10 Gbit/s, with the THR connectors, in which the permissible pull-out forces are about 4-8 times as great as for comparable components using press-in technology, and furthermore offer great mechanical stability.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views:

FIG. 5*c* shows the shield plate with plate set on;

DETAILED DESCRIPTION OF PREFERRED EMBODIMENTS

Figure 1:
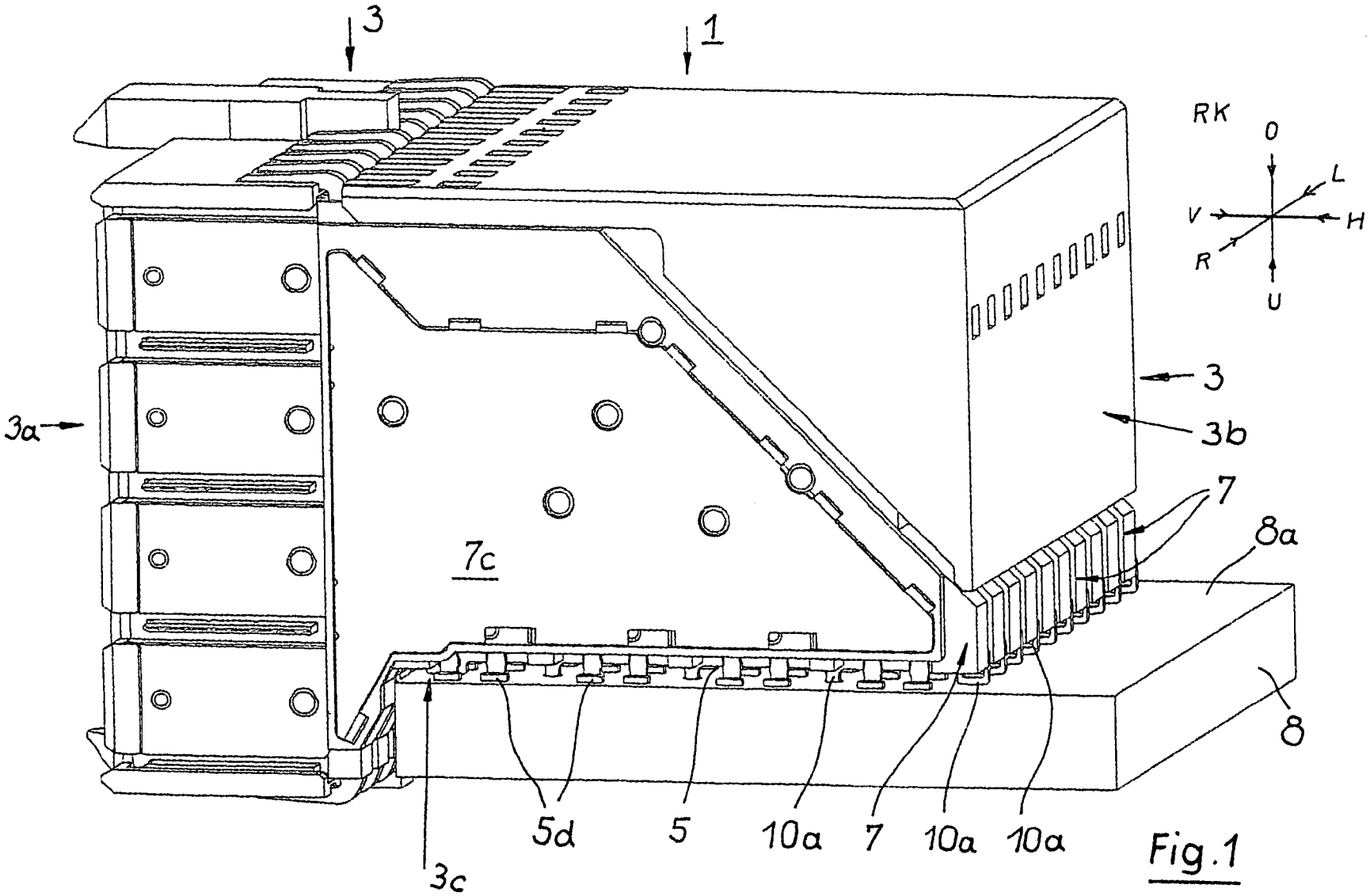
FIG. 1 is a perspective view of a plug-and-socket connector according to the invention, in the embodiment of a multi-row modularly constructed female multi-point connector.

Referring to FIGS. 1-7, the first exemplary embodiment of the plug-and-socket connector configured according to the invention, shown in various views and detail representations, is a female multi-point connector 1 constructed in modular manner. This female multi-point connector 1 is shown in a perspective view, with the viewing direction from the right rear. To facilitate orientation for the following description, a three-axis direction cross RK with regard to the possible viewing directions looking at the body surfaces of the plug-and-socket connector is drawn onto this female multi-point connector in FIG. 1. The reference symbols disposed on this direction cross "RK" have the following meaning:

"V"—viewing direction from the front,

"H"—viewing direction from the rear,

"L"—viewing direction from the left,

"R"—viewing direction from the right,

"O"—viewing direction from the top or above, and

"U"—viewing direction from the bottom or below, onto the plug-and-socket connector.

In the representation shown, the plug-and-socket connector 1 is set onto the assembly surface 8*a* of a printed circuit board 8 with its attachment side 3*c*, in preparation for being fastened there by means of soldering. This female multi-point connector 1 is made up of several female multi-point connector slices 7 disposed next to one another, which are held to lie against one another in a reference position, by means of a common multi-part housing 3. The front of this plug-and-socket connector 1 is designated as 3*a*. Front 3*a* is the connection side of female multi-point connector 1, which can be releasably plugged into a male multi-point connector that has a corresponding structure. The back or rear of housing 3 of plug-and-socket connector 1 is indicated with the reference symbol 3*b* in FIG. 1.

Each female multi-point connector slice 7 for the female multi-point connector module is made up of a base body 7*a*, in which several accommodation channels 7*b* are disposed at a distance from one another. One spring contact 5, in each instance, is positioned in these accommodation channels 7*b*. The accommodation channels 7*b* are open towards front 3*a* and towards attachment side 3*c* of housing 3 of plug-and-socket connector 1.

Spring contacts 5 possess a connection section 5*a*, a center section 5*b*, as well as an attachment section 5*c*. On the end, attachment section 5*c* is configured as an SMD foot 5*d*, which projects out of base body 7*a* of female multi-point connector slice 7 after positioning and fixation of spring contact 5, in each instance, on attachment side 3*c*. To close accommodation channels 7*b* after spring contacts 5 have been laid into them, a cover 7*c* is provided, which preferably is laid into a circumferential recess, so that cover 7*c* does not project beyond the respective side surfaces of base body 7*a*. On the side of base body 7*a* that lies opposite cover 7*c*, a shield plate 10 is laid against base body 7*a*, with regard to electrical shielding of spring contacts 5 placed into female multi-point connector slice 7. To position this shield plate 10 on base body 7*a*, at least one slot-shaped recess 7*d* is provided on base body 7*a*, which here, in a preferred embodiment, penetrates both side surfaces of base body 7*a*. Correspondingly, at least one partial section on shield plate 10 is angled away, and engages into recess 7*d* in base body 7*a*.

Figure 5:
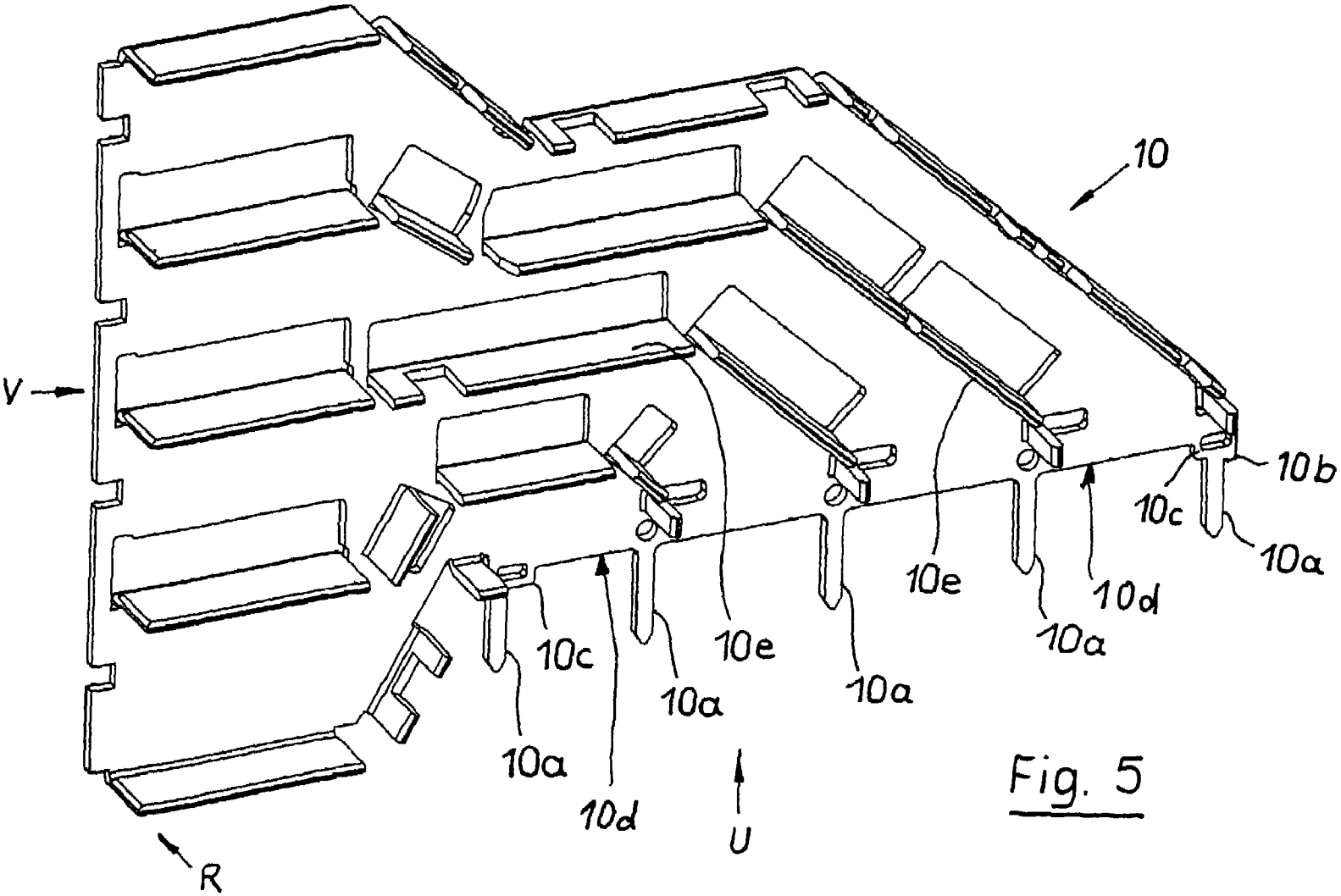
FIG. 5 shows a component, the shield plate, of the female multi-point connector slice according to FIG. 2.

To increase the effectiveness of the shielding, a plurality of recesses 7*d* is provided in base body 7*a* and, corresponding to them, a plurality of angled body sections is provided on shield plate 10, the angled crosspieces 10*e*, see FIG. 5. So that the representation in FIG. 7 does not become confusing, some recesses 7*d* were not shown in the drawing.

Another embodiment of the invention has a special configuration in which at least two of angled crosspieces 10*e* are configured as barbs, in addition to their function as a shielding element, and as such engage in recesses 7*d* of base body 7*a* of female multi-point connector slice 7. In this way, a further improvement in passing on the pull-out forces that act on spring contacts 5, to attachment pins 10*a*, which will be described hereinafter and are connected with printed circuit board 8, are passed on.

The location of recesses 7*d* in base body 7*a* and, correspondingly, the location of angled crosspieces 10*e* on the shield plate, are selected so that accommodation channels 7*b* for spring contacts 5 are shielded on at least three sides in every female multi-point connector slice 7 itself. The shielding of the fourth side of each accommodation channel 7*b* takes place by means of shield plate 10 of a female multi-point connector slice 7 disposed adjacent to it, which plate points towards cover 7*c* of the female multi-point connector slice 7 in question. Shield plate 10 that is provided on each female multi-point connector slice 7 that is provided possesses at least one attachment pin 10*a*, on its body edge 10*d* that lies on its attachment side, which pin projects away in the same body plane. In the case of the exemplary embodiment shown, five attachment pins 10*a* are distributed over the body edge 10*d* in question, according to a predetermined raster, see FIG. 5. These attachment pins 10*a* are introduced into a passage hole 8*b*, in each instance, which holes 8*b* pass through printed circuit board 8, proceeding from assembly surface 8*a*, in accordance with a predetermined raster, in the case of plug-and-socket connectors 1 that are set onto the assembly surface 8*a* of a printed circuit board 8, see also FIG. 4 in this regard.

In a further embodiment, attachment pins 10*a* disposed on the lateral end of body edge 10*d*, in each instance, possess at least one projecting projection 10*b*. Projection 10*b* on the two outer attachment pins 10*a* of shield plate 10 of a female multi-point connector slice 7 guarantees that when plug-and-socket connector 1 is set onto assembly surface 8*a* of printed circuit board 8, SMD feet 5*d* of spring contacts 5 positioned and fixed in female multi-point connector slice 7 in question are disposed at a predetermined distance "a" from assembly surface 8*a* of printed circuit board 8, before they are soldered. This distance "a" between assembly surface 8*a* and SMD feet 5*d* guarantees that all the ends of attachment sections 5*c* of spring contacts 5 lie in a predetermined, low tolerance range coplanar to the conductor tracks—not shown here—that are present on assembly surface 8*a* of printed circuit board 8. In this way, a good SMT design is guaranteed. Attachment pins 10*a* that project into a passage hole 8*b* in printed circuit board 8, in each instance, are connected with printed circuit board 8 using THR technology. In this way, ground connectors for robust plugging in, with secured pull relief, are formed, in other words connectors having great mechanical stability, which is particularly advantageous in the case of a so-called angled plug, in other words in the case of plug-and-socket connectors whose connection side 3*a* lies at 90° relative to attachment side 3*c* (assembly side).

In another special embodiment in the configuration of shield plate 10, projections 10*b*, which act as a spacer, are provided on both sides of attachment pin 10*a*. If necessary, in other words in the case of corresponding requirements with regard to HF technology parameters, the second projection 10*b* can be shortened, so that a projection 10*c* is formed. In this way, in addition to attachment of attachment pin 10*a* in question in printed circuit board 8, using THR technology, it is possible to connect this shortened projection 10*c* with the printed circuit board, using SMT technology, like an SMD foot 5*d* of signal-transmitting spring contacts 5. However, such an embodiment is designed for special user wishes.

Figure 5A:
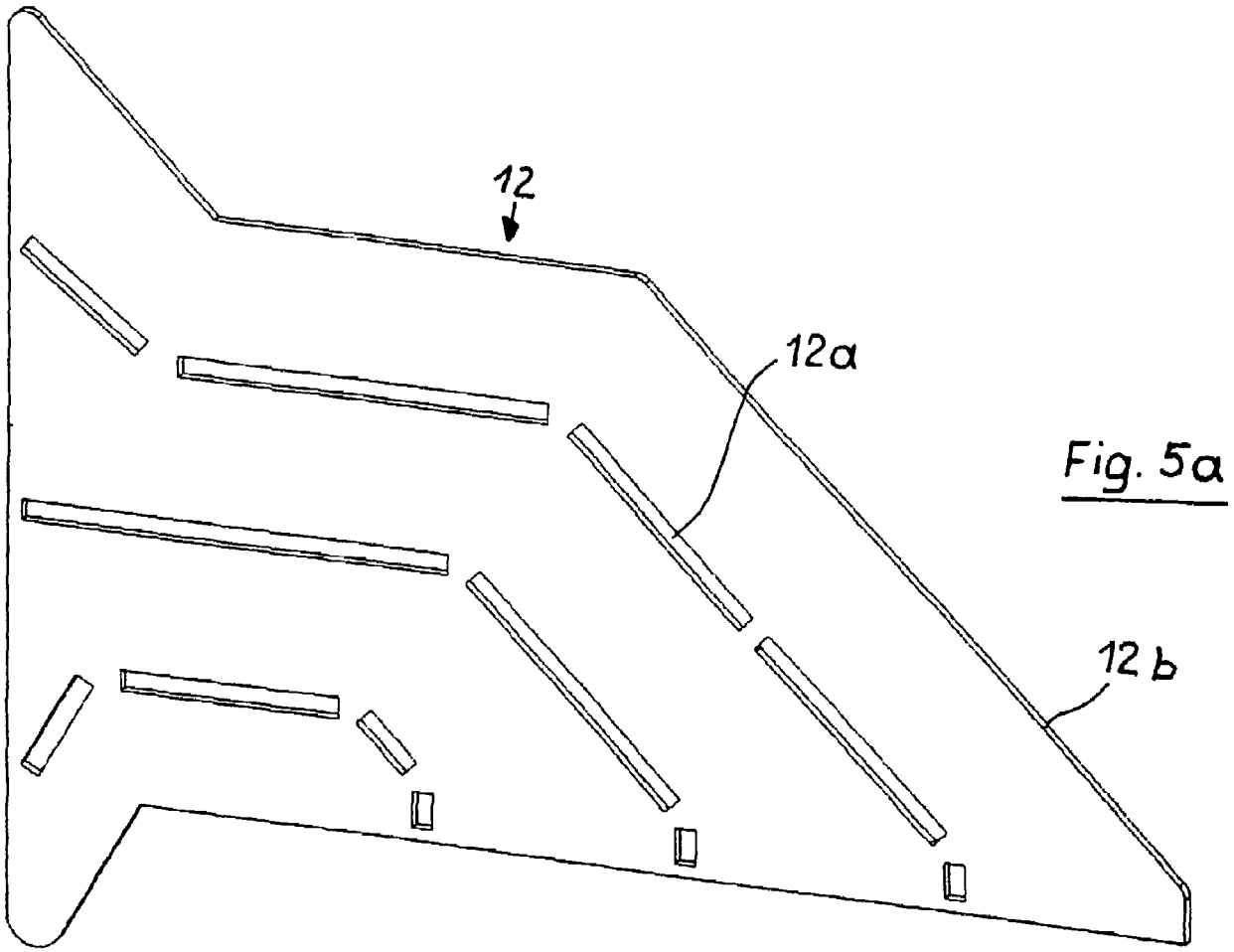
FIG. 5*a* shows a shielding plate.
Figure 5B:
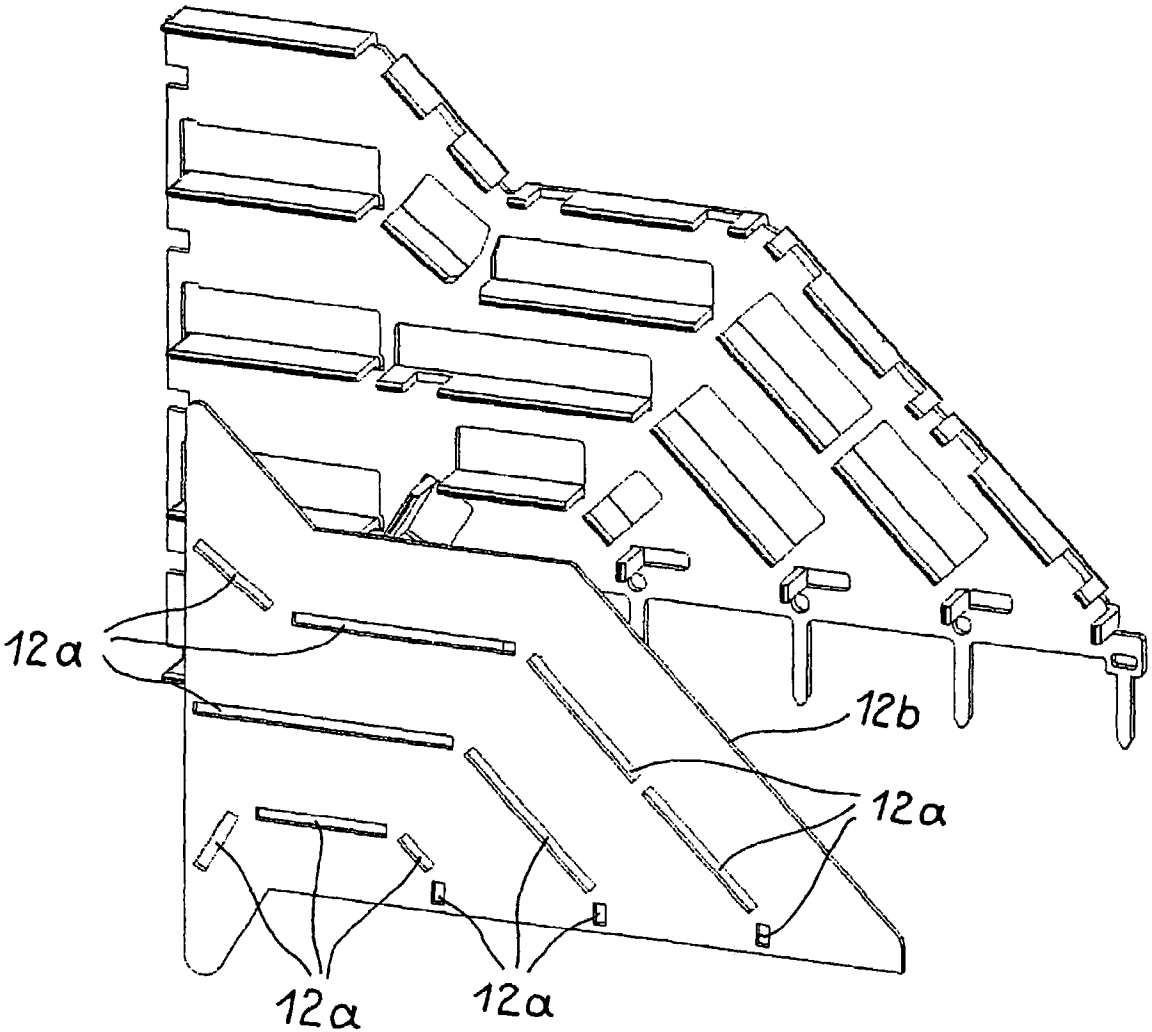
FIG. 5*b* shows the plate according to FIG. 5*a* and the shield plate according to FIG. 5 before its installation.
Figure 5C:
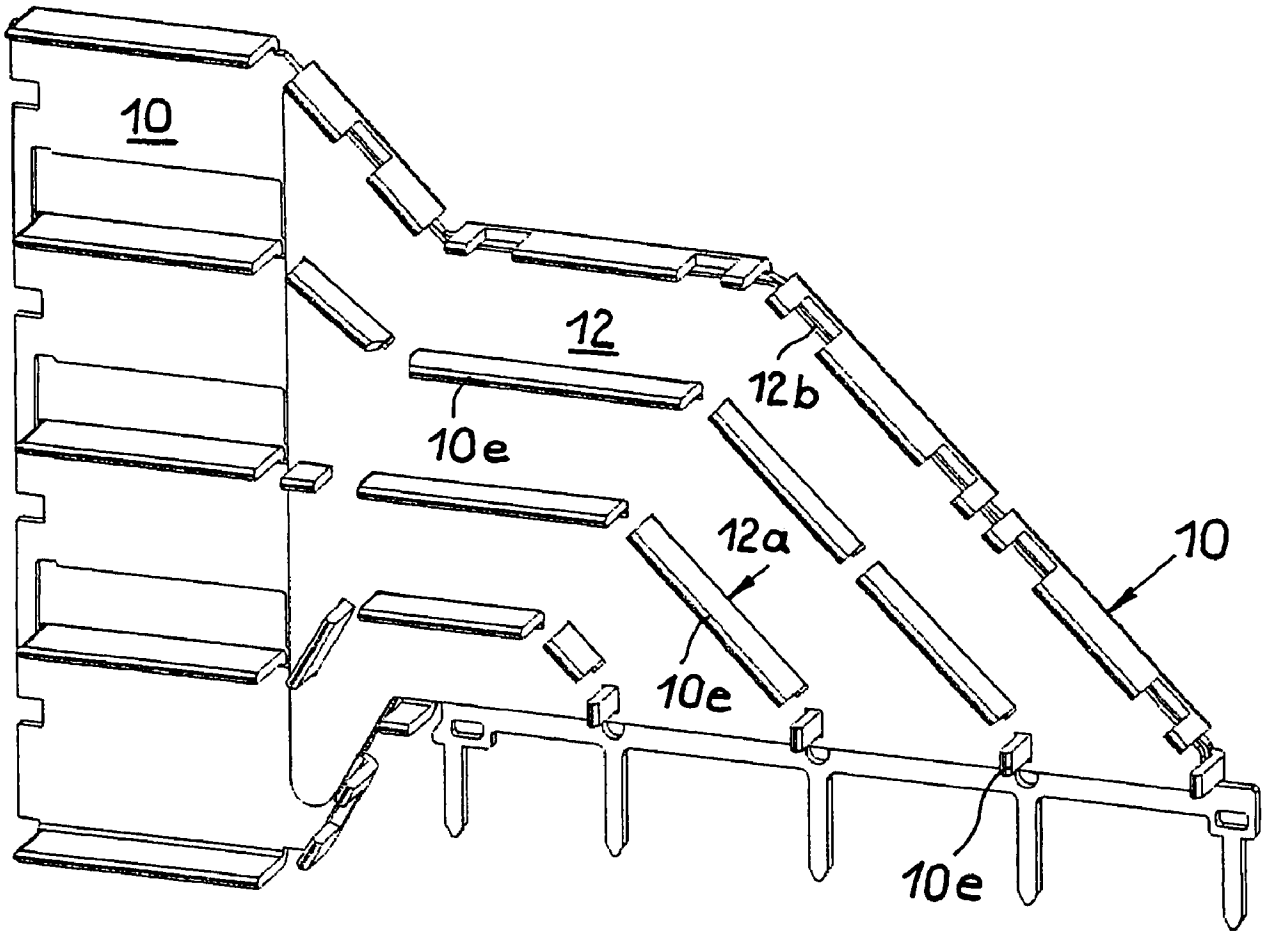
Figure 6:
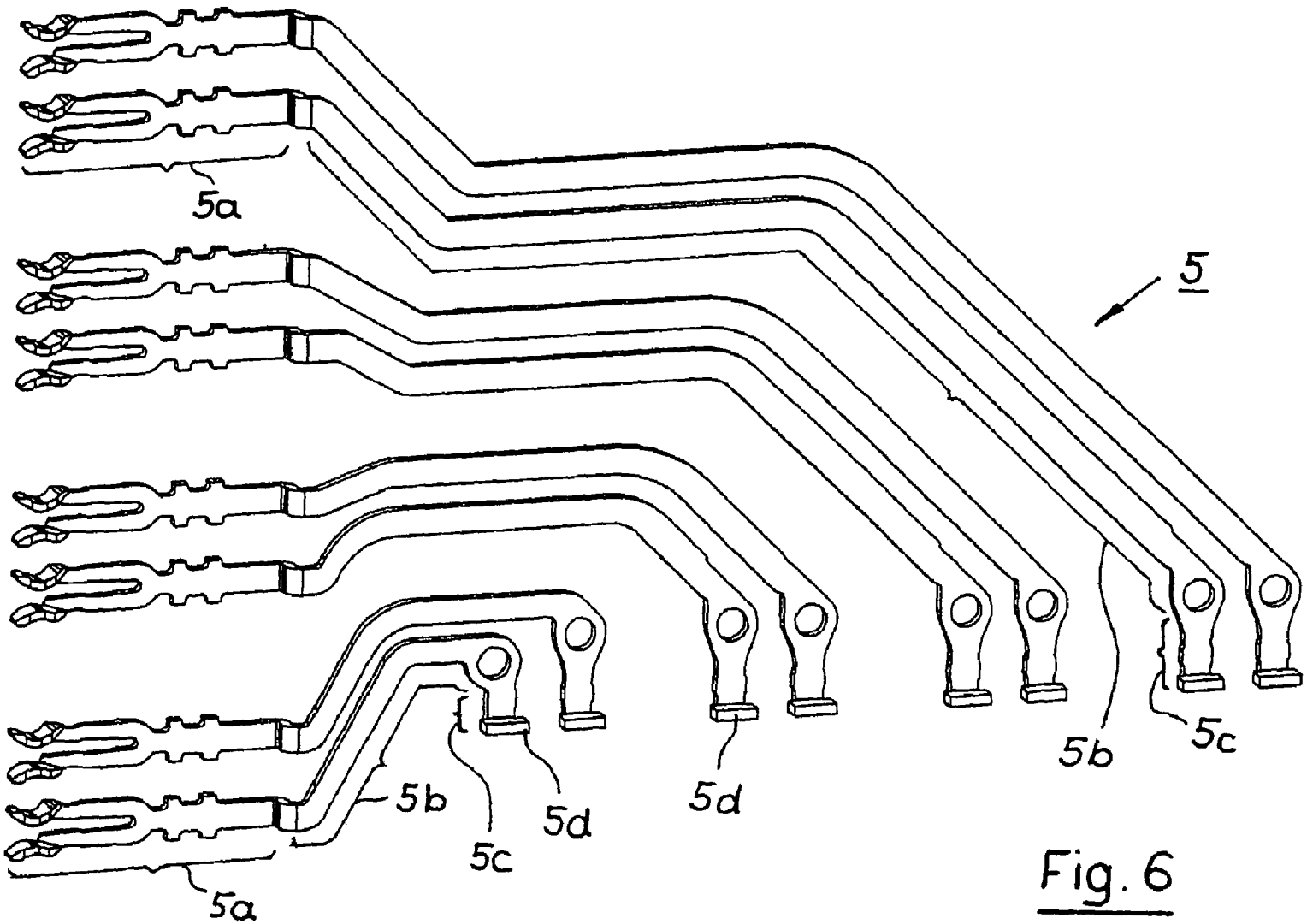
FIG. 6 shows female multi-point connectors for a plug-and-socket connector according to FIG. 1.
Figure 7:
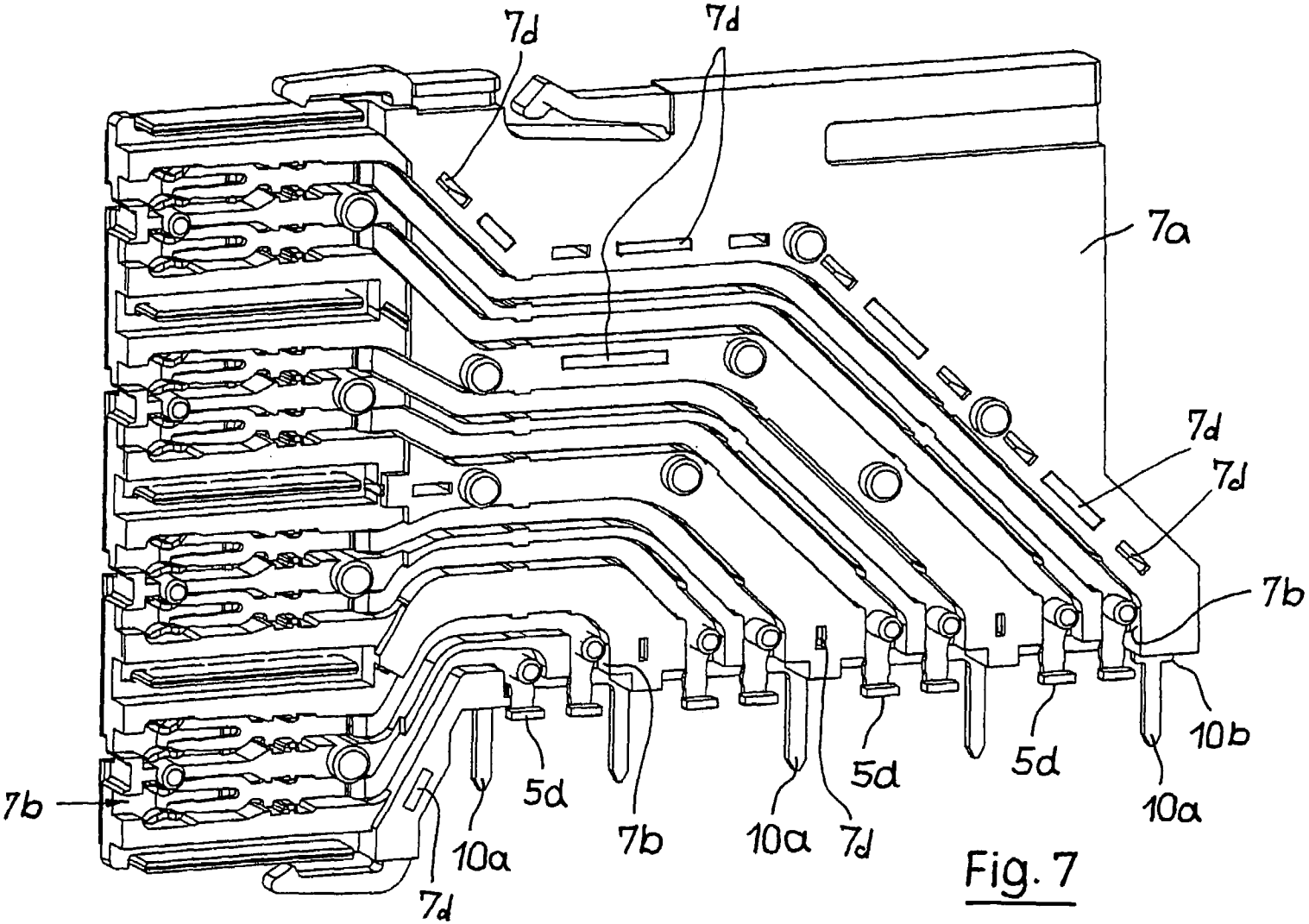
FIG. 7 shows the base body of a female multi-point connector slice according to FIG. 2 with female multi-point connectors and shield plate positioned on same.

As a result of angled crosspieces 10*e* on shield plate 10, openings occur, which could be disadvantageous, under some circumstances, particularly in the case of the transmission of very high data rates significantly above 10 Gbit/s. Therefore, the embodiment explained above can be supplemented by providing another shield plate before assembly of shield plate 10 on base body 7*a* of a female multi-point connector slice 7. Specifically, an electrically shielding plate 12 is provided, the outer body contour 12*b* of which corresponds to that of the partial region of shield plate 10. The additional inner shield plate 12 has a plurality of recesses 12*a*. Crosspieces 10*e* of shield plate 10 can be inserted through these recesses 12*a*, see FIGS. 5*a*, 5*b*, and 5*c* in this regard. Plate 12 laid against shield plate 10 from "the inside" closes off these openings in shield plate 10.

Figure 2:
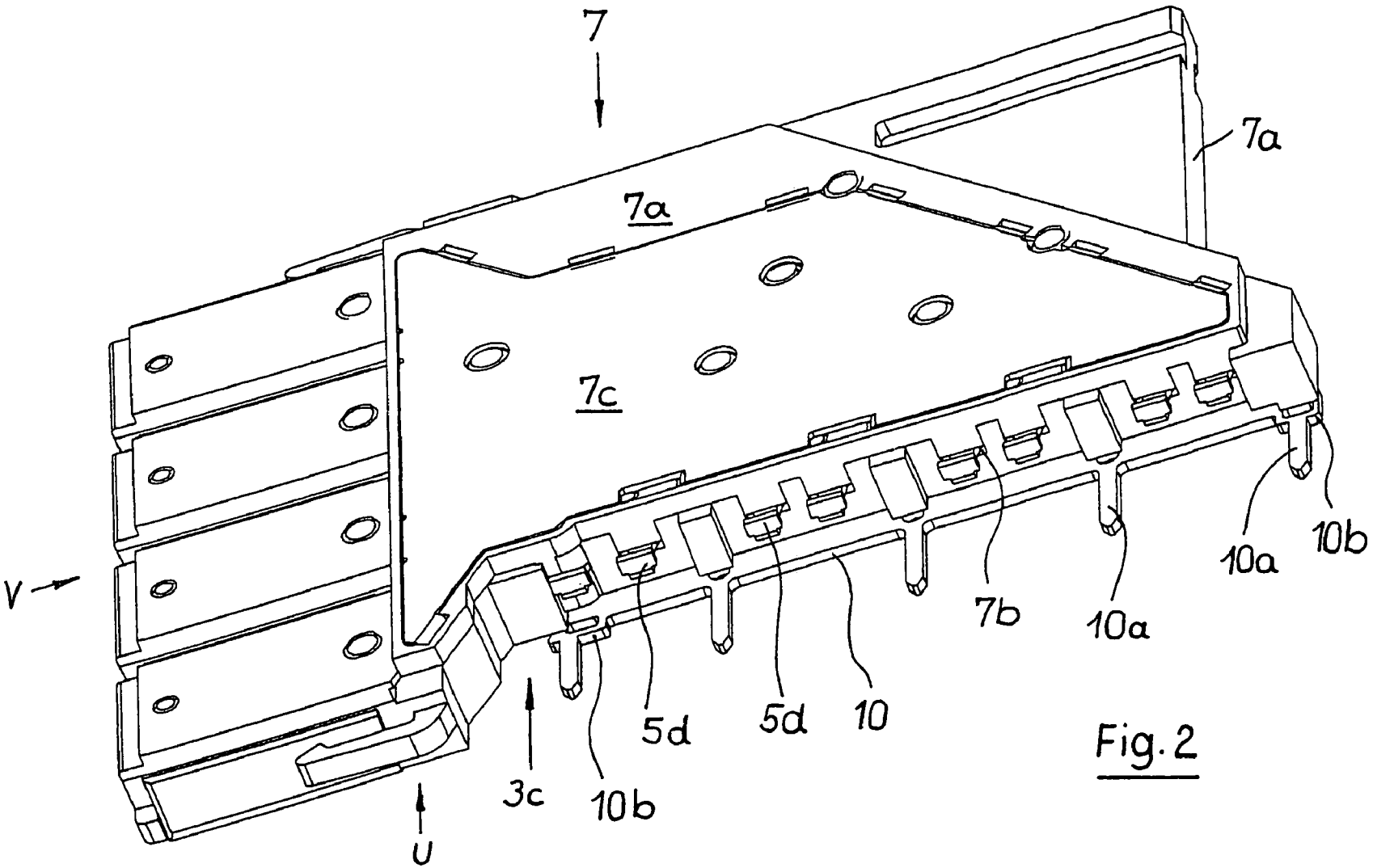
FIG. 2 shows a female multi-point connector slice (female multi-point connector module) of the plug-and-socket connector according to FIG. 1.
Figure 3:
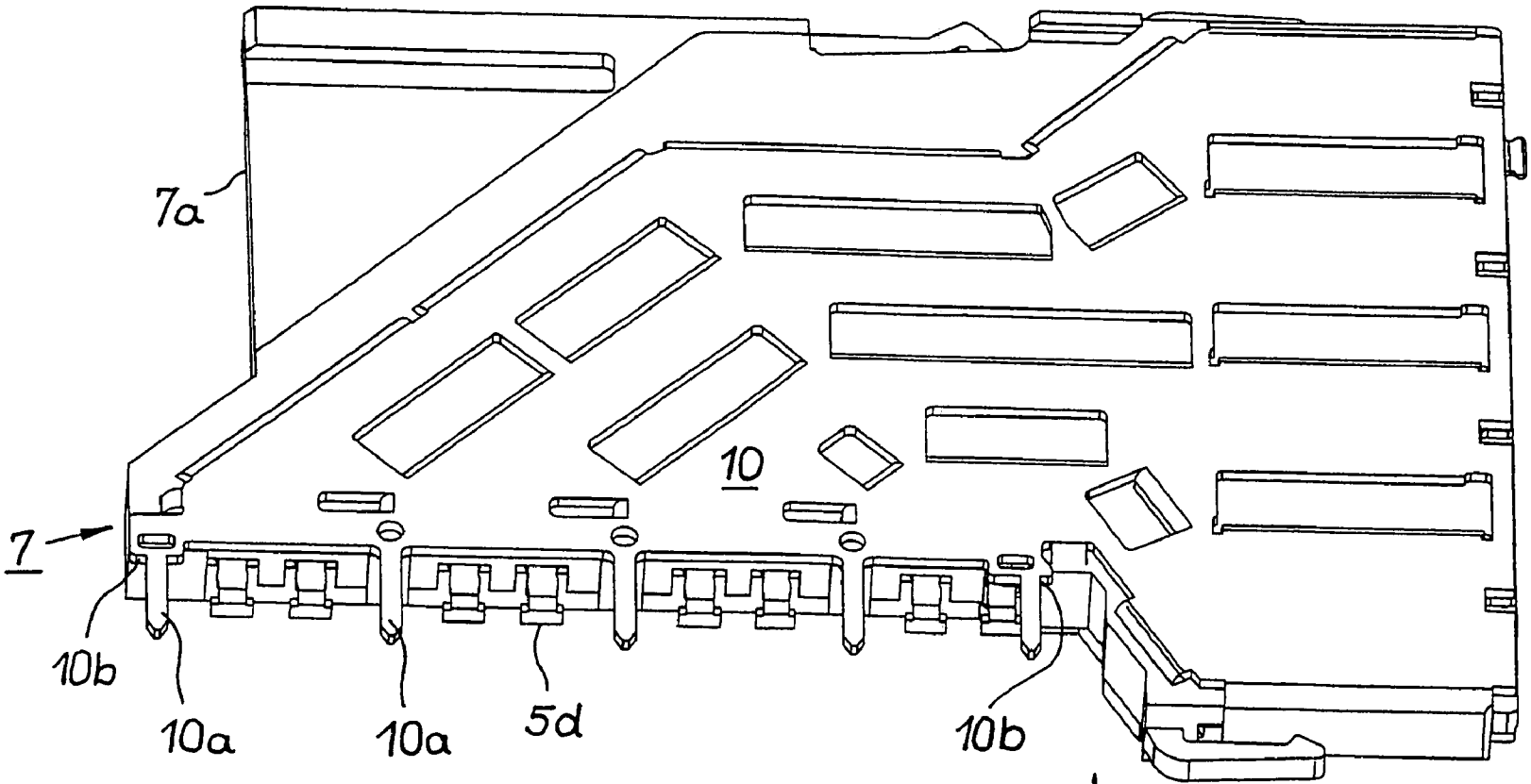
FIG. 3 is a view of the female multi-point connector slice according to FIG. 2 rotated by 180°.
Figure 4:
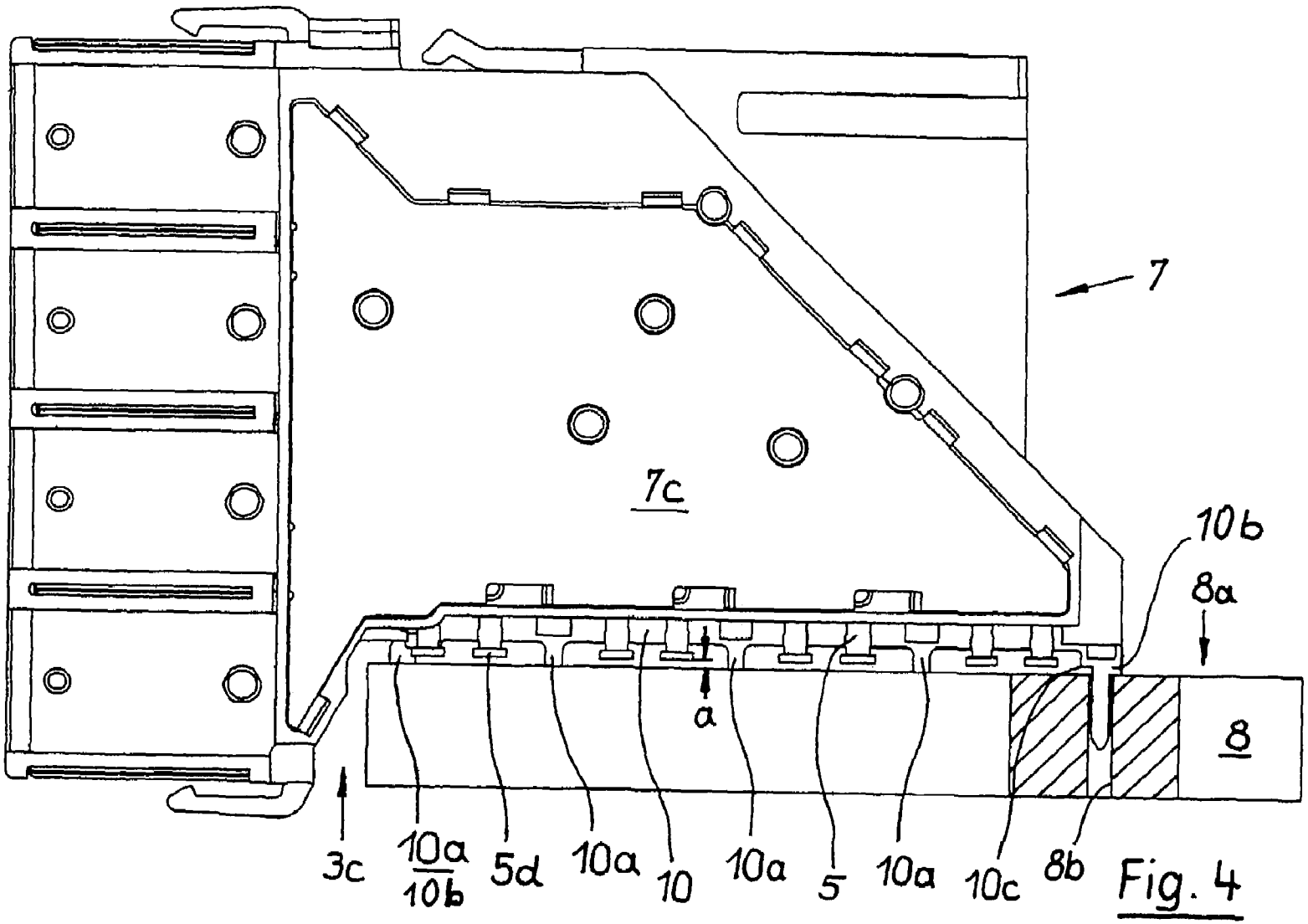
FIG. 4 shows a female multi-point connector slice according to FIG. 2, set onto the assembly surface of a printed circuit board.

FIGS. 2 and 3 show a female multi-point connector slice 7 of female multi-point connector 1 (FIG. 1) in perspective, one from the left and one from the right. From these two representations, it is evident that in the case of the exemplary embodiment shown in FIGS. 1-7, of a female multi-point connector 1 structured in modular manner, attachment side 3*c* connectors of spring contacts 5 and of shield plate 10 are disposed in two lines that are spaced apart from one another.

According to another embodiment, not shown here, it is provided, according to the invention, that attachment pins 10*a* are angled away twice by 90° with reference to body edge 10*d* from which they project, so that the sections of these attachment pins 10*a* that engage into the printed circuit board come to lie in a line with SMD feet 5*d* of spring contacts 5. If the thickness of female multi-point connector slices 7 is configured accordingly, a greater number of contacts can be disposed on a predetermined surface, as a result.

Figure 8:
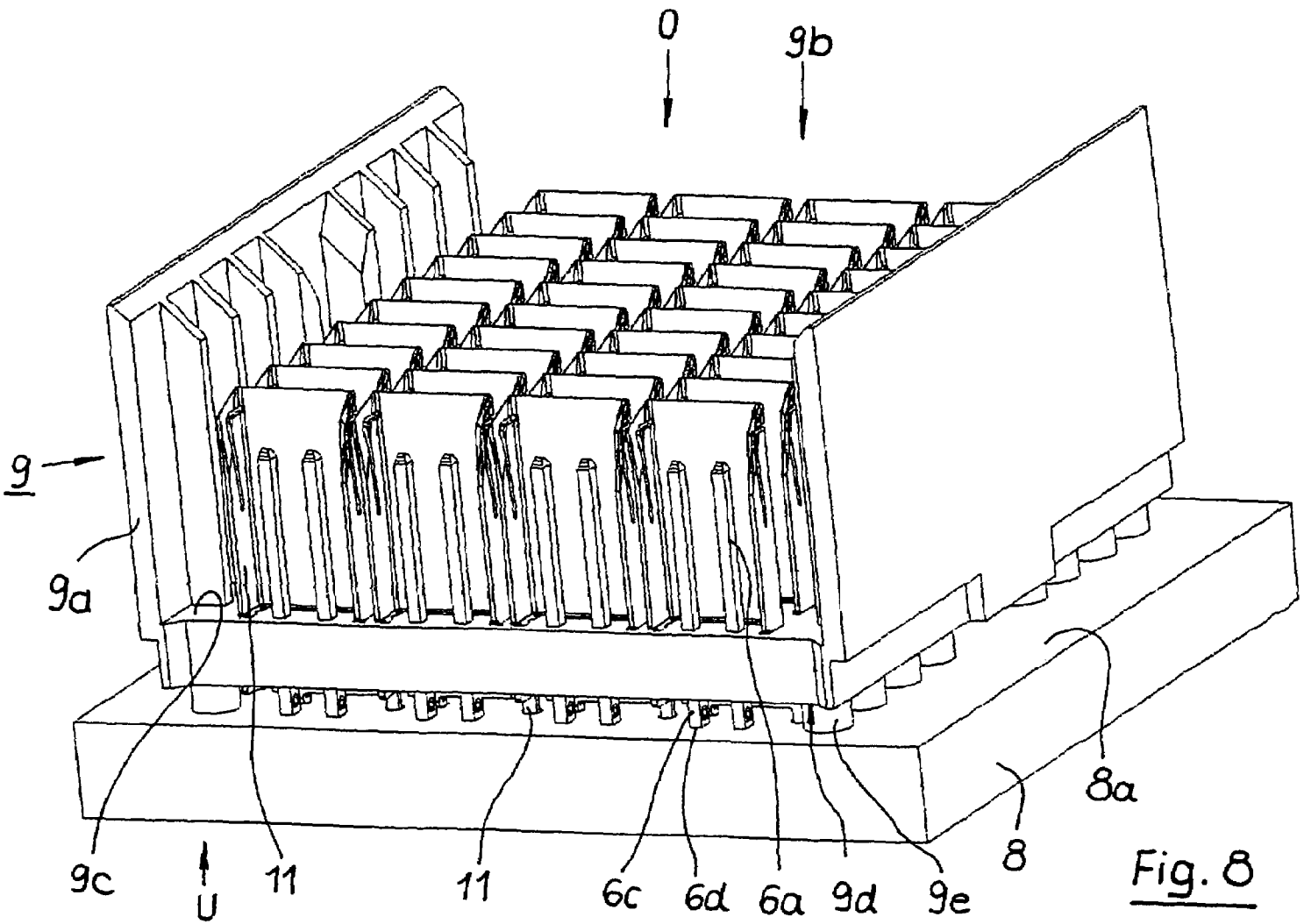
FIG. 8 shows a plug-and-socket connector according to the invention in an embodiment as a male multi-point connector.
Figure 9:
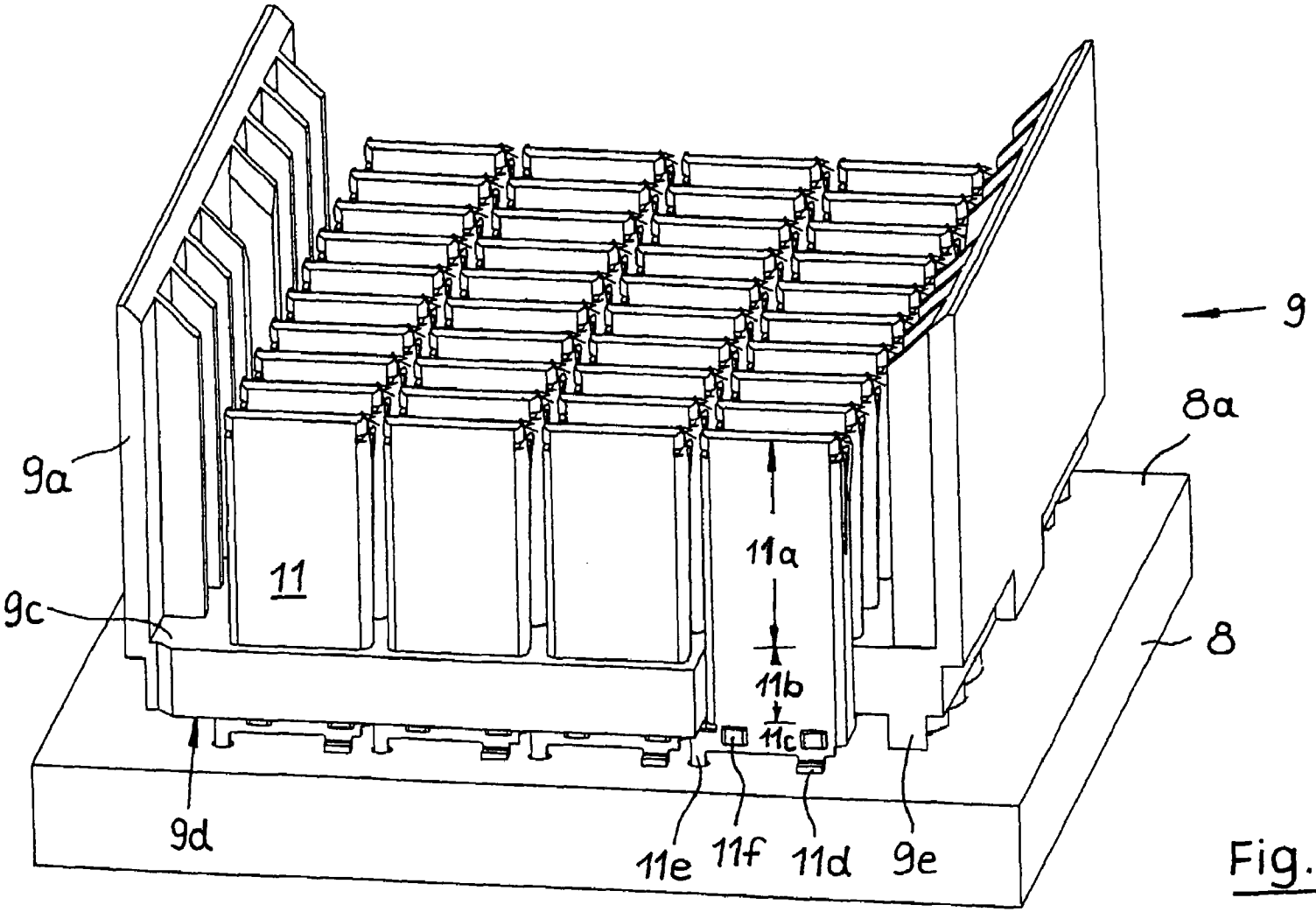
FIGS. 9 and 10 show details relating to the male multi-point connector according to FIG. 8.
Figure 10:
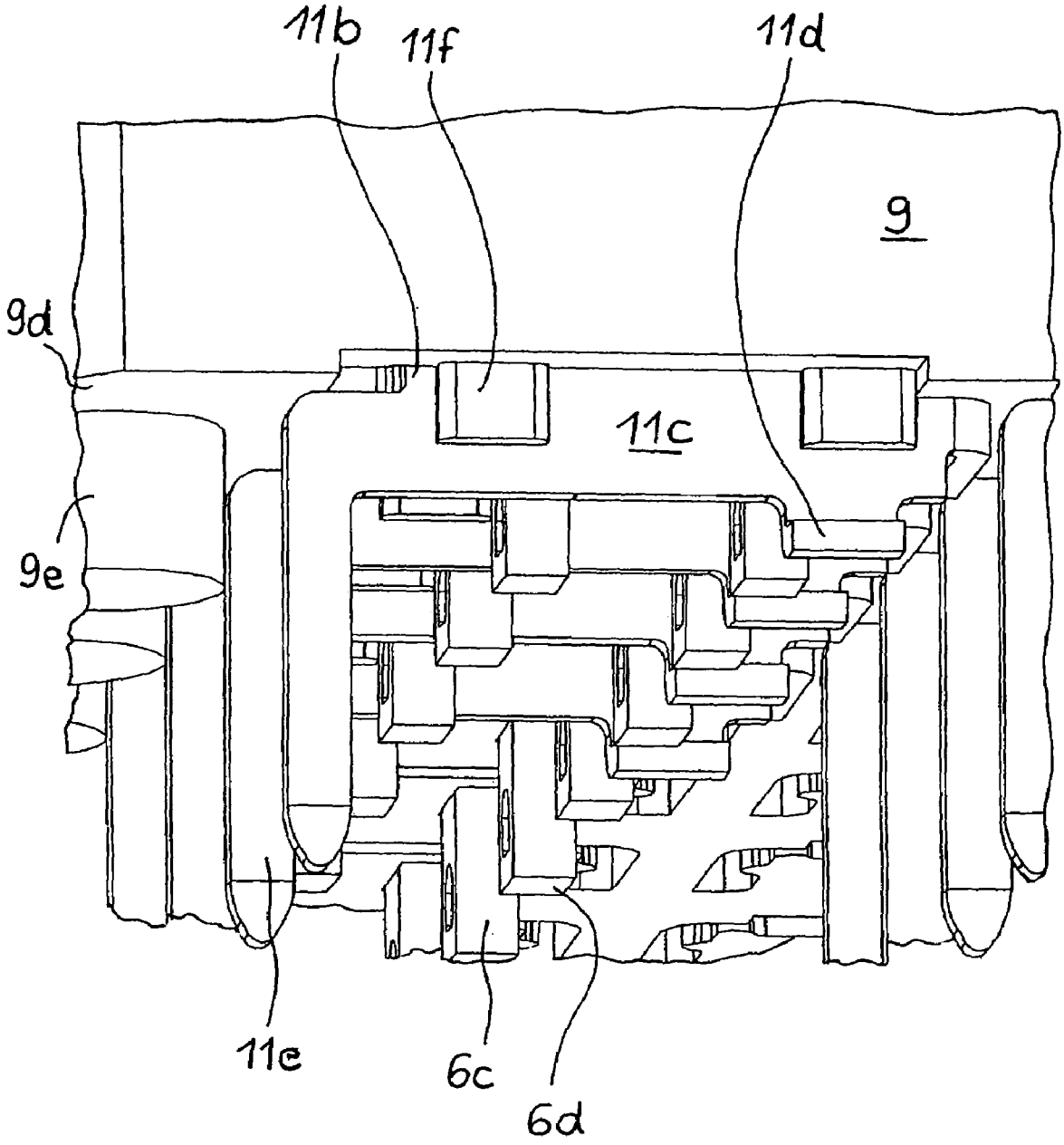

A second embodiment of a plug-and-socket connector configured according to the invention is shown in FIGS. 8 to 10, a male multi-point connector 9 that can be plugged together with a female multi-point connector 1 described above, to produce an electrical connection/connections, in other words form a plug-and-socket connection. In the case of the male multi-point connector shown in FIGS. 8 to 10, shield profile parts 11 are provided for electrical shielding of its pin contacts 6, which parts surround a pair of pin contacts 6 on three sides, in each instance. Pin contacts 6 possess a connection section 6*a*, in each instance, which engages into a connection section 5*a* of a spring contact 5 of a female multi-point connector slice 7, if male multi-point connector 9 and female multi-point connector 1 have been plugged together. Each pin contact 6 is held in the bottom of the base body 9*a* of male multi-point connector 9 with a center section 6*b*, with a press fit. Attachment section 6*c* then projects from the bottom; its end is configured as an SMD foot 6*d*. The distance between assembly surface 8*a* of a printed circuit board 8 and the lower surface of each SMD foot 6*d*, which must be predetermined for assembly and SMT attachment, is predetermined by means of spacer parts 9*e* provided on the assembly side,—here—at the side of base body 9*a*.

The opening in body 9*a* of male multi-point connector 9 is designated as 9*b*; this opening ensures that this male multi-point connector 9 can be inserted into front 3*a* of housing 3 of plug-and-socket connector 1. The body part or connection section of shield profile parts 11 that projects upward "O" from the inner bottom surface 9*c* is designated as 11*a*. The lower section of each shield profile part 11 that projects out of the outer bottom surface of base body 9*a* is a contact section 11*c* that is connected with the assembly surface of the printed circuit board. The guide section 11*b*, which passes through the bottom of base body 9*a* and is held in base body 9*a* with a press fit, is located between connection section 11*a* and contact section 11*c*.

In order to counteract greater pull-out forces that cannot be foreseen, but do occur under some circumstances, at least one additional projection or stop 11*f* that projects laterally from the body surface and rests against outer bottom surface 9*d* is provided in the transition region of contact section 11*c* to guide section 11*b*. The lower region of contact section 11*c* of a shield profile part 11 is formed as an attachment pin 11*e* on one side, and as an SMD foot 11*d* on the other side. This embodiment makes it possible for male multi-point connector 9 to be attached to a printed circuit board using SMT technology, on the one hand, to make use of the HF technology advantages and, on the other hand, to produce the required great mechanical stability, by connecting the attachment pins 10*e* with printed circuit board 8 using THR technology.

Although several embodiments of the present invention have been shown and described, it is to be understood that many changes and modifications may be made thereunto without departing from the spirit and scope of the invention as defined in the appended claims.

What is claimed is:

1. A multi-pole, multi-row plug-and-socket connector with shielding for placement on an electrical component usable in an electrical or electronic system comprising (a) a housing having an assembly side;

(b) a plurality of electrical contact parts for transmission of signals, each electrical contact part comprising a connection section on a first end of said electrical contact part and an electrically conductive attachment section on a second end of said electrical contact part; and (c) an electrical shield comprising at least one electrically conductive contact section;

wherein the plug-and-socket connector is a modular female multi-point connector having at least two female multi-point connector slices;

wherein the electrical shield comprises a shield plate on each female multi-point connector slice and at least two attachment pins disposed at an end on each side of a body edge of the shield plate that lies on the assembly side, each of said at least two attachment pin having a projection that projects away laterally from said shield plate;

wherein each female multi-point connector slice comprises a base body and an electrically shielding plate disposed on an inside surface of the shield plate of each female multi-point connector slice facing the base body of the female multi-point connector slice, said electrically shielding plate covering at least a partial region of the inner surface of the shield plate;

wherein the attachment sections of said electrical contact parts project out of the housing on the assembly side and are disposed with the contact section of the electrical shield according to a predetermined raster, said attachment sections and said electrical shield being connectable with the electrical component via soldering; and wherein said attachment sections have free ends comprising surface mount device (SMD) contacts and said at least one electrically conductive contact section of the shield comprises an attachment pin projecting into a passage hole of the electrical component when the plug-and-socket connector is disposed on the electrical component for connective soldering using through-hole reflow (THR) technology.

2. The plug-and-socket connector according to claim 1, further comprising at least one inside attachment pin without a projection disposed on said body edge between two of said at least two attachment pins.

3. The plug-and-socket connector according to claim 1, wherein each shield plate is disposed in a respective body plane and the attachment pins provided on said side body edge are bent twice by an angle of 90°, so that the section of each attachment pin that engages into the electrical component is disposed in a plane that lies lateral to the body plane of the shield plate.

4. The plug-and-socket connector according to claim 1, wherein at least one of the at least two attachment pins has a first lateral projection on a first side of the attachment pin and a second lateral projection on a second side of the attachment pin.

5. The plug-and-socket connector according to claim 4, wherein one of the first and second lateral projections is shorter than the other projection.

6. The plug-and-socket connector according to claim 1, wherein the shield plate has at least two angled crosspieces, each angled crosspiece engaging into a recess of the base body of the female multi-point connector slice.

7. The plug-and-socket connector according to claim 6, wherein at least two of the angled crosspieces of the shield plate comprise barbs that also act as shields.

8. The plug-and-socket connector according to claim 6 wherein each angled crosspiece extends through the recess.

9. The plug-and-socket connector according to claim 8, further comprising a respective cover provided on the base body of each female multi-point connector slice, opposite the shield plate, and covering accommodation channels of the female multi-point connector slice, each cover comprising an electrically conductive shielding plate contacting the crosspieces that extend through the base body.

10. A multi-pole, multi-row plug-and-socket connector with shielding for placement on an electrical component usable in an electrical or electronic system comprising (a) a housing having an assembly side;

(b) a base body having an outer bottom surface; and (c) a plurality of electrical pin contact parts for transmission of signals, each pin contact comprising an electrically conductive attachment section on an end of said pin contact part and disposed on the outer bottom surface;

wherein the plug-and-socket connector comprises a male multi-point connector plugged into a female multi-point connector;

wherein the male multi-point connector comprises an electrical shield comprising at least one electrically conductive contact section, said electrical shield of the male multi-point connector comprising a plurality of shield profile parts surrounding a respective pair of the pin contacts on three sides, the shield profile parts extending through the bottom of the base body of the male multi-point connector and surrounding and shielding the attachment sections of the pin contacts that are disposed outside of the outer bottom surface;

wherein the attachment sections of said pin contact parts project out of the housing on the assembly side and are disposed with the contact section of the electrical shield according to a predetermined raster, said attachment sections and said electrical shield being connectable with the electrical component via soldering; and wherein said attachment sections have free ends comprising surface mount device (SMD) contacts and said at least one electrically conductive contact section of the shield comprises an attachment pin projecting into a passage hole of the electrical component when the plug-and-socket connector is disposed on the electrical component for connective soldering using through-hole reflow (THR) technology.

11. The plug-and-socket connector according to claim 10, wherein each shield profile part has at least one stop that projects out of a body surface of the shield profile part, on an assembly side contact section of the shield profile part.

12. The plug-and-socket connector according to claim 11, further comprising an attachment pin projecting away from the assembly side contact section, said pin, after the male multi-point connector has been set onto an assembly surface of an electrical component, projecting into a passage hole of the electrical component for soldering using through-hole reflow technology.

13. The plug-and-socket connector according to claim 11, wherein an SMD foot is disposed on the lower edge of the assembly side contact section of the shield profile part.

* * * * *